United States Patent [19]

Drouin

[11] 4,207,863

[45] Jun. 17, 1980

[54] DOOR FOR PYROLYTIC RANGE

[75] Inventor: Claude Drouin, Montmagny, Canada

[73] Assignee: Les Industries BFG Limitee, Montmagny, Canada

[21] Appl. No.: 883,197

[22] Filed: Mar. 3, 1978

Related U.S. Application Data

[62] Division of Ser. No. 757,434, Jan. 6, 1977, Pat. No. 4,163,444.

[51] Int. Cl.[2] ..... F23M 7/00

[52] U.S. Cl. ..... 126/198; 126/200

[58] Field of Search ..... 126/197, 198, 200, 193, 126/190

[56] References Cited

U.S. PATENT DOCUMENTS

| | | | |
|---|---|---|---|
| 2,823,660 | 2/1958 | Holzgoog | 126/190 |
| 3,024,074 | 3/1962 | Jacobs | 126/198 |
| 3,453,997 | 7/1968 | Klepzig | 126/198 |
| 3,782,360 | 1/1974 | Brucken | 126/198 |

*Primary Examiner*—Samuel Scott
*Assistant Examiner*—G. Anderson

[57] ABSTRACT

The disclosure herein describes a door for covering the oven cavity of a pyrolytic range, which comprises four spaced panels that define therebetween three air cooling passageways providing an insulating effect; inlet and outlet openings are located in the top and bottom edges of the door to allow air to circulate in the passageways to reduce heat loss through the window sections of the door so that the temperature on the front panel of the door, during the high temperature self-cleaning cycle of the oven, does not exceed the allowable limit. The invention is also concerned with providing a continuous gasket on the front wall of the oven portion of the range to trap air on the sides of the oven and to direct it upwards through orifices leading to underneath the top cooking surface of the oven from where it exits.

4 Claims, 4 Drawing Figures

DOOR FOR PYROLYTIC RANGE

This is a divisional application of Ser. No. 757,434, filed Jan. 6, 1977, now U.S. Pat. No. 4,163,444.

FIELD OF THE INVENTION

The present invention relates to cooking ovens and, more particularly, to window doors covering the oven cavity of pyrolytic ranges having a high temperature self-cleaning cycle.

BACKGROUND OF THE INVENTION

The self-cleaning temperature of a pyrolytic oven is in the neighborhood of 900° F. and strict government regulations have been set concerning the allowable surface temperature on the outside panel of the oven door during the self-cleaning cycle. This has resulted in the designing of sophisticated doors where manually movable radiation blocking shields or shutters are used to cover the windowed sections of the door. Such protective devices may be found described in U.S. Pat. Nos. 3,749,081 issued July 31, 1973, 3,881,462 issued May 6, 1975 and 3,893,442 issued July 8, 1975 and they serve to reduce heat loss through these windowed sections and thereby lower the temperature on the front face of the door.

OBJECTS AND SUMMARY OF THE INVENTION

One object of the present invention is to provide a windowed door for covering the oven cavity of a pyrolytic range in which the temperature of the external face of the door does not exceed the allowable limit but without having to rely on the use of manually operable shutters or shields to reduce the heat loss through the window passage.

A further object of the present invention is to provide an oven door provided with a series of panels having window sections in registry to allow viewing inside the oven cavity during the cooking operation as well as during the self-cleaning operation.

Another object of the present invention is to provide a windowed oven door of the class described which is provided with a series of air cooling channels for reducing the external temperature of the door.

The present invention therefore relates to a door for covering the oven cavity of a pyrolytic range having a high temperature self-cleaning cycle, which comprises: a front panel including a first window section; an intermediate second panel spaced rearwardly of the front panel and defining therewith a first air passageway and including a second window section; an intermediate third panel spaced rearwardly of the second panel and defining therewith a second air cooling passageway and including a third window section; a rear panel spaced rearwardly of the third panel and defining therewith a third air passageway and including a fourth window section; the glass window sections being in viewing registry whereby, even during the high temperature cycle, the oven cavity may be viewed; and inlet and outlet opening means respectively provided at the bottom and top edges of the door for allowing cooling air to flow in the three passageways whereby the three passageways provide an insulating effect and reduce heat loss through the window sections whereby the temperature on the front face of the first window section during the self-cleaning cycle is below a predetermined allowable limit for said front face. This temperature is one which may be bearable if the front face is touched by hand in the area of the window registry. It is recommended that any points of the front surface do not exceed 212° F.

Other objects, purposes and characteristic features of the present invention will be in part obvious from the accompanying drawings and in part pointed out as the description of the invention progresses. In describing the invention in detail, reference will be made to the accompanying drawings.

DESCRIPTION OF PREFERRED EMBODIMENT

Figure 1:
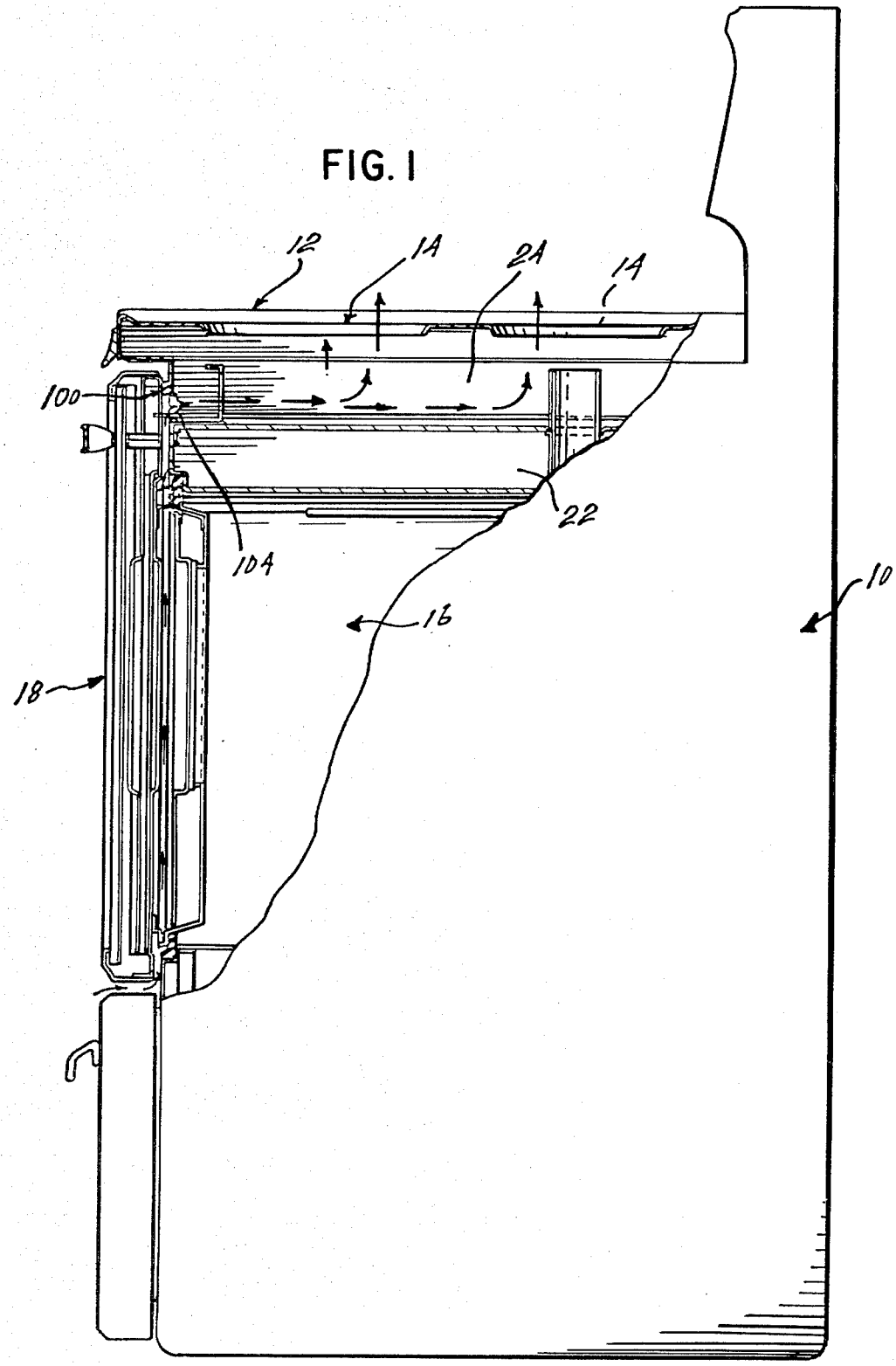
FIG. 1 is a side elevational view, partly broken away, of a pyrolytic range embodying the present invention.

Referring to FIG. 1 there is shown a free standing domestic range 10 having a top cooking surface 12 with a plurality of orifices 14 adapted to receive therein surface heating elements (not shown). A baking and broiling oven 16 is located beneath the cooking surface 12 and has a construction which is well known in the art; a description thereof will not be given since it does not form part of the present invention. A door 18 closes the oven cavity 16.

Located beneath the top cooking surface 12 and above the top wall of the oven liner 22, an air evacuation passageway 24 allows hot air to be evacuated through orifices 14 of the top cooking surface 12. The origin of this hot air flow will be described hereinbelow.

Figure 2:
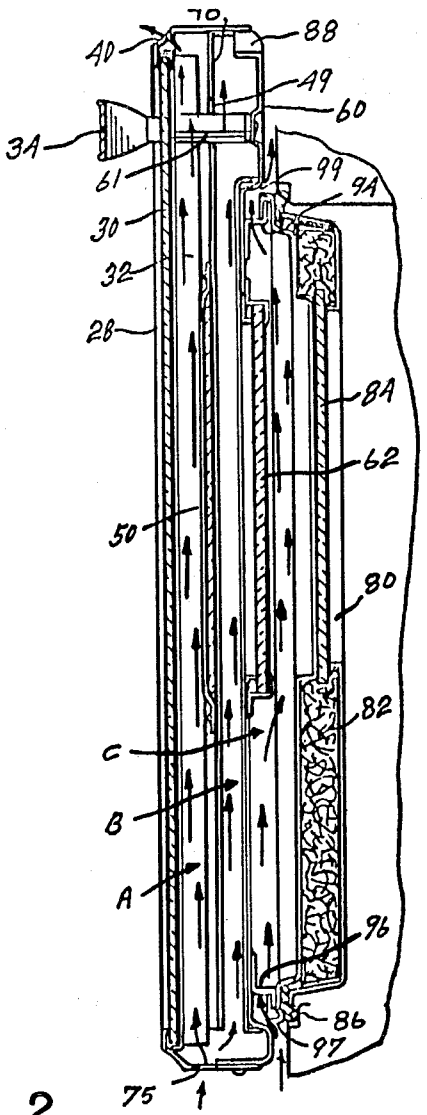
FIG. 2 is a cross-sectional elevational view on a larger scale of the door of the range.
Figure 3:
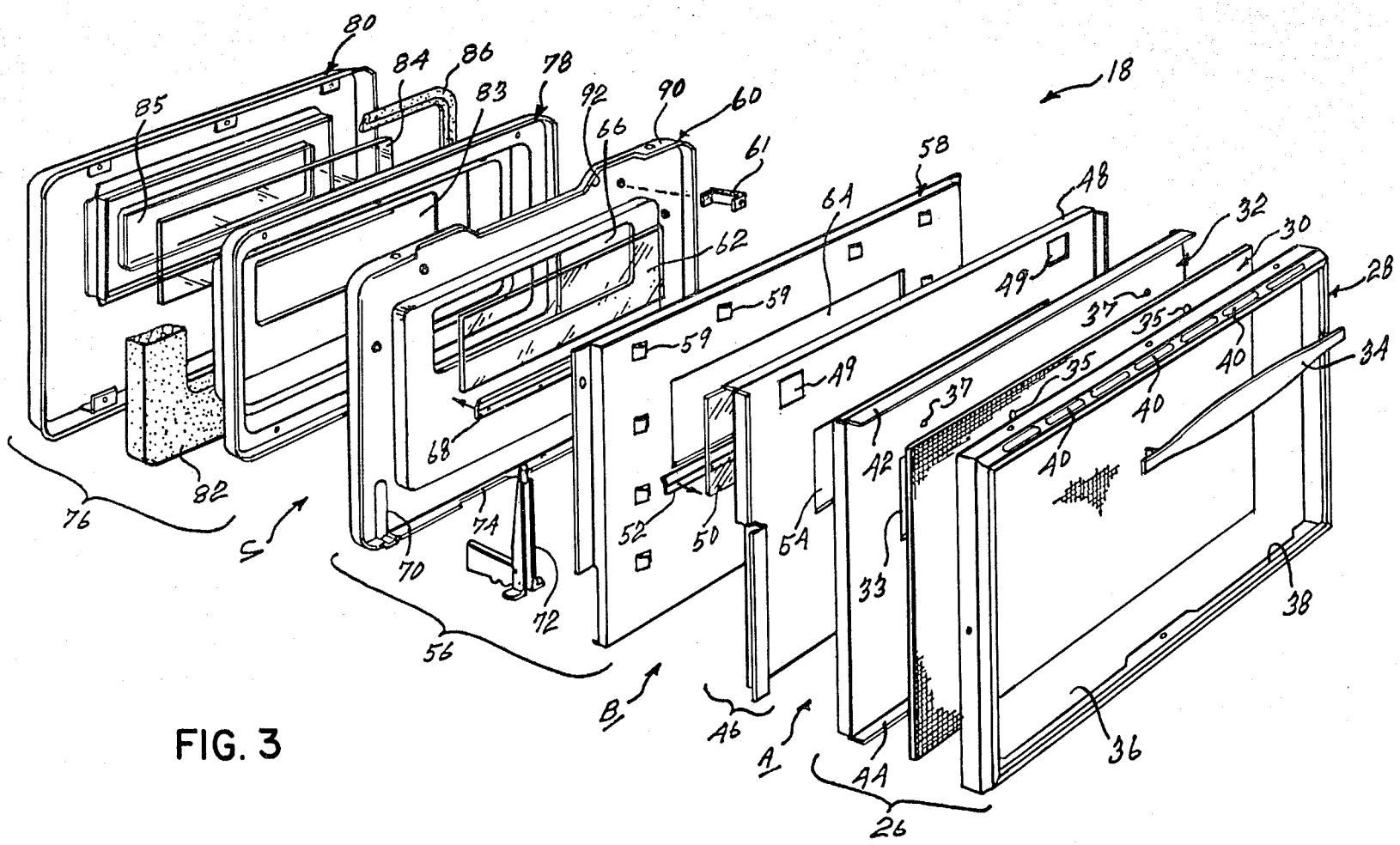
FIG. 3 is a perspective view in exploded form showing the door of the range made in accordance with the present invention.

Referring more particularly to FIGS. 2 and 3, the door 18 first includes a front or cover panel 26 consisting of a rectangular shaped metallic frame 28, a screened tempered glass pane 30 and an outer metallic deflector 32. The lower border element of frame 28 includes two recessed portions 36 and 38 while the upper border element thereof includes a series of air outlet openings 40 spaced therealong. Deflector 32 has a rectangular shaped opening 33 and two frontwardly bent upper and lower edges 42 and 44 in which is received pane 30.

An intermediate second panel 46 is disposed at spaced interval from the front panel 26 and consists of a single panel member 48 equipped with rectangular shaped opening 54. A pane of tempered glass 50 is supported over opening 54 by means of a support plate 52 which has its lower portion secured to the panel member 48 beneath opening 54.

Spaced rearwardly of panel 46, an intermediate third panel 56 is provided and consists of a metallic inner deflector 58 and of liner 60. A pane 62 of tempered glass, having its inner face coated with a reflective material to reflect heat towards the oven cavity, is supported in plate 68 secured to liner 60 beneath the rectangular-shaped opening 66 thereof. Deflector 58 also includes a rectangular opening 64. Suitable openings 70 are provided in the lower part of liner 60 to receive the door hinge members 72 (one being shown). The lower edge of panel 60 includes two recess portions, one of which is shown at 74 so that, when the door is assembled, they form with recess portions 36 and 38 of panel 26 adequate air entry orifices 75 at the lower edge of the door The door also includes a fourth or rear panel 76 that consists of an inner liner 78 and an outer liner 80 between which heat insulation material 82, such as fiber glass, is enclosed. A pane of glass 84, made of borosilicate, covers openings 83 and 85 of liners 78 and 80. A gasket 86 ensures tight engagement between liners 78 and 80 when assembled.

Panels 26 and 46 define therebetween a first passageway A whereby cooling air enters through orifices 75 provided at the lower edge of the door and exits at the upper edge thereof through openings 40. In so doing, the air lowers the temperature on window panes 30 and 50.

A second air passageway B is provided between panels 46 and 56, the cooling air entering from the same orifices 75 as that of air passageway A but exiting through orifices 88 which is formed by the recess 92 in the top edge 90 of panel 60.

A third air passageway C is provided between panel 56 and panel 76. Upper and lower spacers 94 and 96 provide a distance between panels 56 and 76 for air passage. Air entry is provided at the lower edge 97 of panel 78 while air outlet is provided at the upper edge 99 of panel 78. The air outlet of the third passageway C extends vertically below the air outlet 88 of air passage B. The evacuation of hot air in passageway C will further be described hereinbelow in connection with the description relative to FIG. 4.

The above-described construction of a door for use in a pyrolytic range lowers the temperature on the front door panel so that, even if the temperature inside the oven cavity during the self-cleaning cycle is high, it can be touched without causing burn or even, touched in a bearable manner. This is achieved by providing successive air cooling spaces which are defined by heat reflecting panels and by providing parallel air passageways which gradually reduce the temperature between the inner and outer faces of the door.

Figure 4:
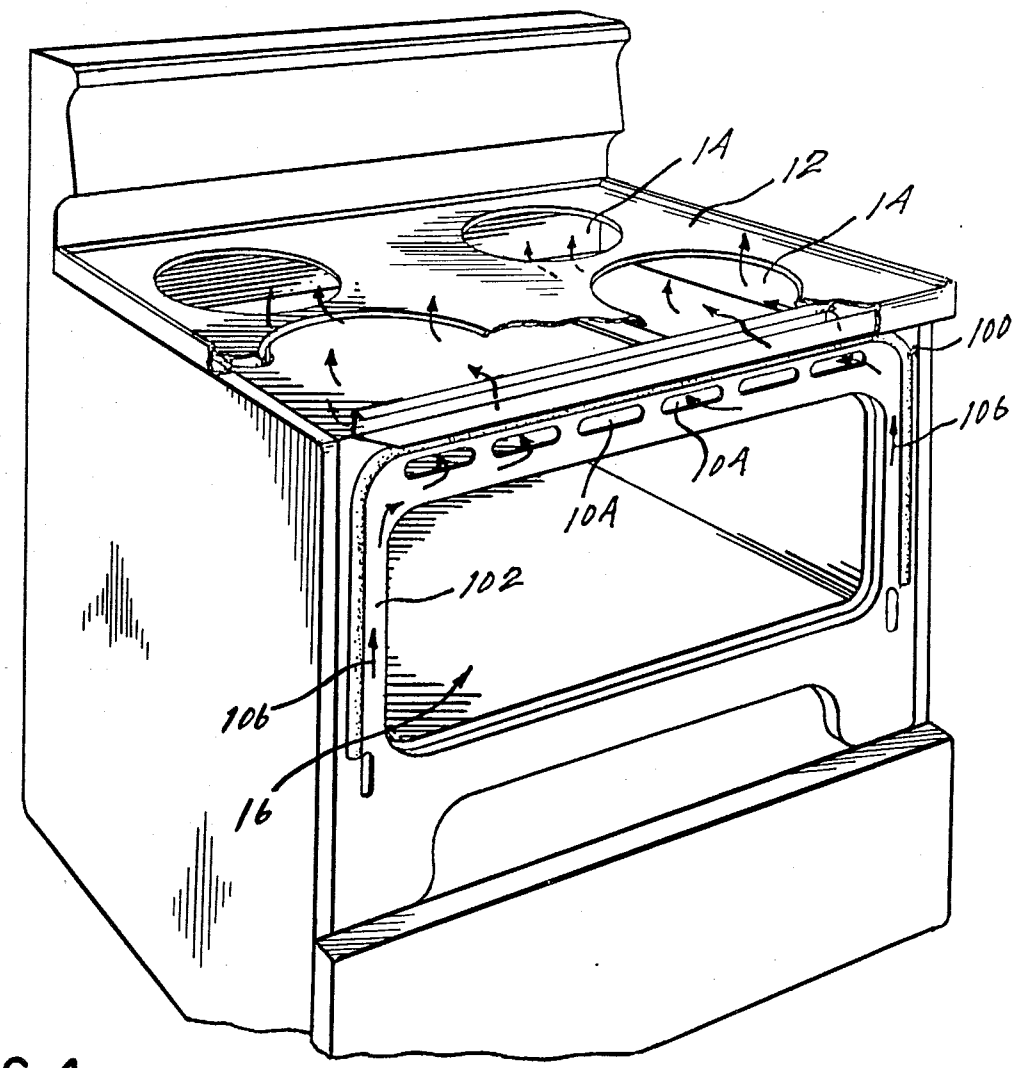
FIG. 4 is a perspective view, partly broken away, showing a range equipped with a gasket made in accordance with another feature of the present invention.

Referring to FIG. 4 of the drawings, a continuous gasket 100 is shown fixedly mounted to the sides and top of the front wall 102 of the oven liner 16 (the door having been removed for clarity). The upper portion of the front wall 102 is provided with a series of orifices 104 extending beneath gasket 100. The hot air on the sides of the door is trapped by the vertical portions of the gasket and is directed upwards as indicated by arrow 106. The hot air is then directed through orifices 104 beneath the top cooking surface 12 of the range where it subsequently exits outside through orifices 14. Orifices 104 also serve to evacuate the hot air circulating between panels 56 and 76 in passageway C.

What is claimed is:

1. A range comprising: a top cooking surface including air evacuation means therethrough; an oven located beneath said cooking surface consisting of a forwardly opening cavity and adjacent front wall means including top, bottom and sidewalls; a door closing said walls and said cavity; said door comprising a series of spaced parallel panels defining therebetween a series of air passageways; each said panel including a window section; said door further comprising inlet and outlet openings located at the top and bottom edges thereof for allowing cooling air to flow in said passageways to reduce the temperature of said window sections; air outlet means in said top wall in air flowing connection with said air evacuation means of said top cooking surface; and a continuous gasket extending between said door and said top and side walls; said gasket being received on said top wall above said air outlet means, whereby air circulating in one of said passageways is trapped by said gasket as it exits said outlet openings along said side walls between said door and said wall means, and is directed upwards and evacuated through said air evacuation means of said top cooking surface.

2. A range as defined in claim 1, wherein said gasket is fixedly attached to said top wall and to said side walls of said oven.

3. A range as defined in claim 1, wherein said top cooking surface includes surface heating elements and wherein said air evacuation means is located beneath at least one of said surface heating elements.

4. A range as defined in claim 1, wherein said one of said air passageways is the innermost air passageway of said door.

* * * * *